US005746289A

United States Patent [19]

Williams

[11] Patent Number: 5,746,289

[45] Date of Patent: May 5, 1998

[54] SCAFFOLD HATCH SYSTEM

[75] Inventor: Joe W. Williams, Varnado, La.

[73] Assignee: Excel Modular Scaffold and Leasing Corporation, Carson City, Nev.

[21] Appl. No.: 447,238

[22] Filed: May 22, 1995

[51] Int. Cl.[6] ..... E04G 5/00

[52] U.S. Cl. ..... 182/129; 182/179

[58] Field of Search ..... 182/179, 178, 182/77, 81, 129; 49/381, 340; 52/200

[56] References Cited

U.S. PATENT DOCUMENTS

| | | | |
|---|---|---|---|
| 1,621,539 | 3/1927 | Hemingway | 182/77 |
| 2,840,289 | 6/1958 | Murray | 182/77 |
| 2,853,161 | 9/1958 | Mascari | 49/505 |
| 3,181,650 | 5/1965 | Cutter | 182/179 |
| 3,183,873 | 5/1965 | Hamilton | 49/340 X |
| 3,565,212 | 2/1971 | Johnson | 182/179 X |
| 5,088,577 | 2/1992 | Pierce | 182/179 X |
| 5,103,934 | 4/1992 | Brooks | 182/77 X |
| 5,475,955 | 12/1995 | Dickinson | 182/81 X |

*Primary Examiner*—Alvin C. Chin-Shue
*Attorney, Agent, or Firm*—Gilliam, Duncan&Harms

[57] ABSTRACT

A scaffold hatch system including a frame member with an opening therethrough, the frame member being supportably attachable to a scaffolding system, the scaffolding system including a plurality of horizontal support members, a plurality of vertical support members and a floor having a walking surface with a passageway therethrough, where the opening of the frame is alignable with the passageway. The invention includes several flanges for attachment to a scaffold system. A hatch attached to the frame to cover the opening is also provided, as is a ladder to access the hatch.

15 Claims, 4 Drawing Sheets

SCAFFOLD HATCH SYSTEM

FIELD OF INVENTION

This invention relates to scaffold systems, in particular, to devices for accessing a scaffold systems floor.

BACKGROUND ART

Scaffold systems are used to elevate a work area for ease of access to a project. Elevating the work area, however, presents problems for those who are required to work on that elevated surface. In particular, users must climb to the elevated surface; workers either climb a ladder place exterior to the scaffold, or, for frame scaffolding, climb the exterior of a scaffold section, using the horizontal support members of a scaffold section as ladder rungs. This is inherently dangerous, for to access the working surface of a scaffold section, a worker must climb around the walking surface as it extends outward from a scaffold section and/or a worker must climb through a system of ropes, chains, or horizontal tubes placed above the walking surface to prevent workers from falling off that surface.

SUMMARY OF THE INVENTION

A scaffold hatch system is provided for accessing the walking surface of a scaffold system through a passageway in the walking surface where the scaffold hatch system is a frame having an opening, the opening sized to align with the passageway and the frame to be supportable by a scaffold system. The frame may be provided with a hatch to close the opening to prevent a worker from falling through the opening. The scaffold hatch system may be provided with a ladder for accessing the hatch.

OBJECTS OF INVENTION

It is an object of the invention to provide an apparatus to allow a worker to safely access a scaffold walking surface.

It is an object of the invention to allow a worker to safely access the walking surface of a scaffold through the interior of a scaffold system.

It is an object of the invention to provide a hatched access opening where the hatch, when closed, is substantially aligned with the walking surface to result in a surface uninterrupted with protrusions which could cause a worker to trip.

It is another object of the invention to provide a hatched access opening which is securely attached to a scaffold system.

It is another object of the present invention to provide a portable hatched access opening for use in a scaffold system.

It is another object of the present invention to provide a hatched access opening for use in a scaffold system which requires a minimum modification to the present elements of a scaffold system.

It is another object of the present invention to provide a lightweight, minimum sized hatched access opening for use in a scaffold system.

These and other objects, advantages, and features of this invention will be apparent from the following descriptions of the invention.

DETAILED DESCRIPTION OF THE INVENTION

Figure 1:
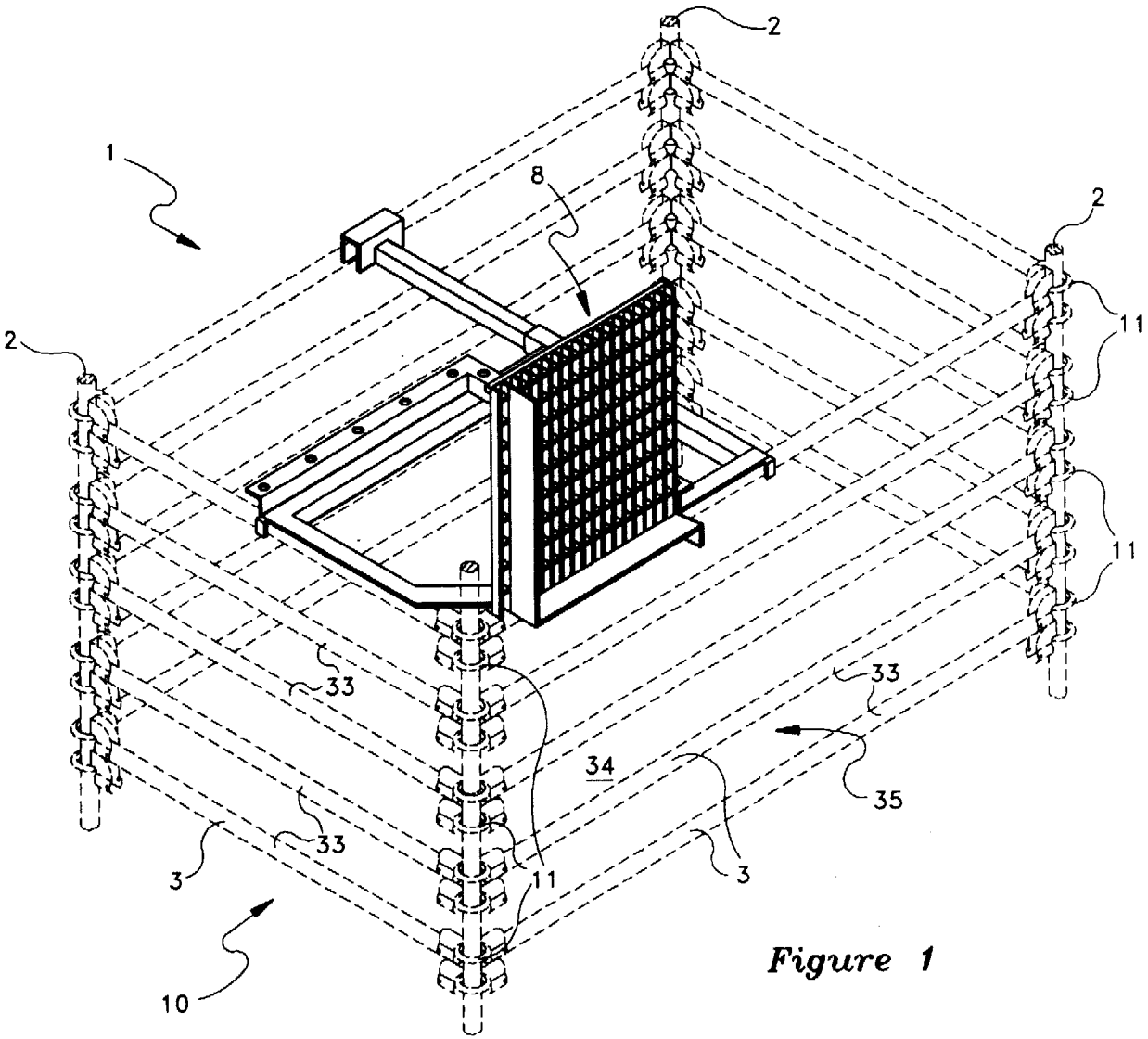
FIG. 1 is an prespective view of an embodiment of the invention installed in a scaffolding system.
Figure 3:
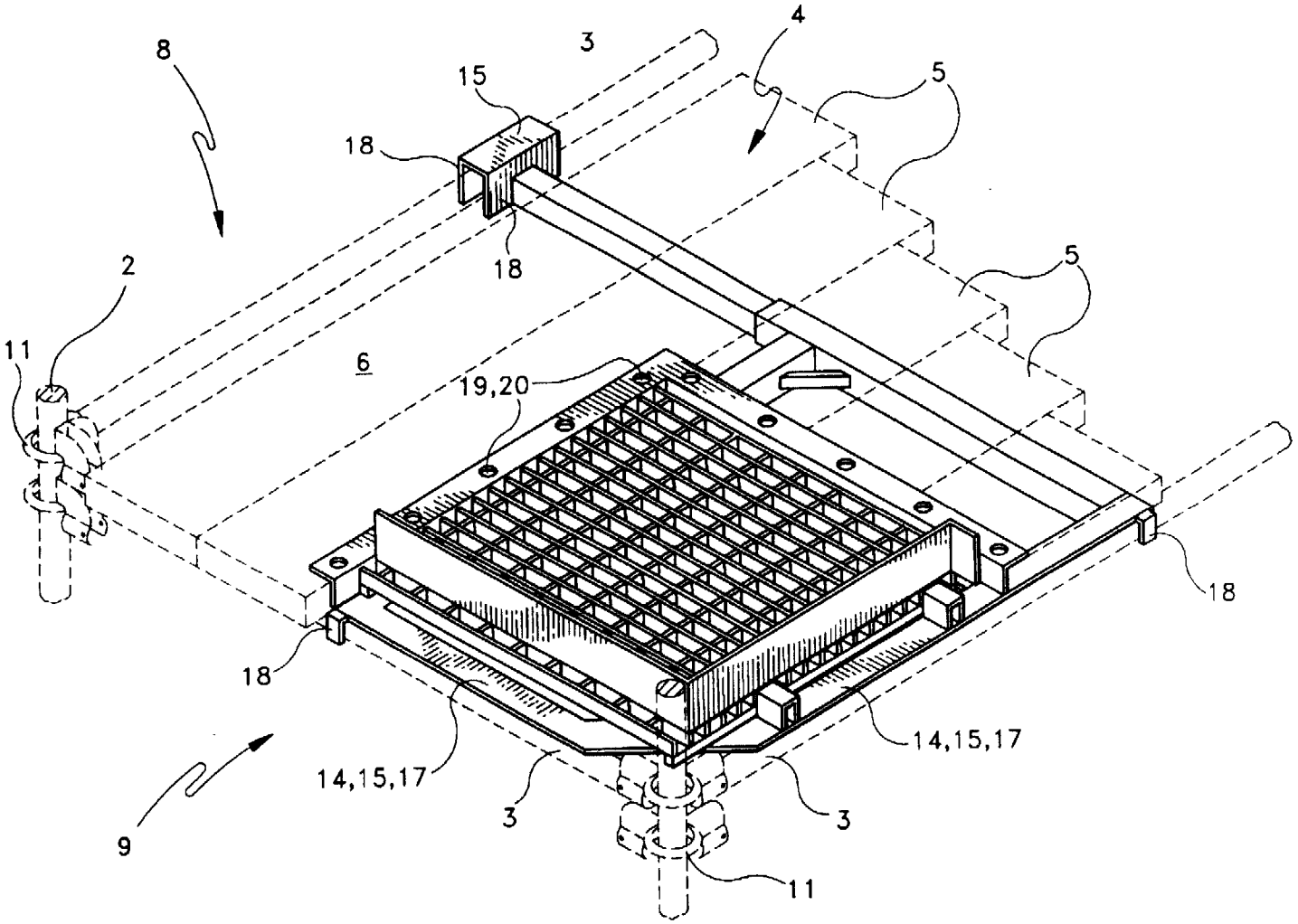
FIG. 3 is a view of the invention showing the invention installed in a scaffold floor with the hatch closed.

Turning to the drawings, FIG. 1 shows a scaffold system 1 having a plurality of vertical support members 2 and a plurality of horizontal support members 3 attached thereto forming a scaffold section 10. Scaffold section 10 has an interior 34 and an exterior 35. Cups 11 on the vertical support members 2 provide an attachment point for connecting a vertical support member 2 to a horizontal support member 3. Other embodiments of scaffold sections 10 are known to those in the arts. Most such scaffold sections 10 are of standard width and length, being five feet wide and eight feet long. Scaffold system 1 includes a floor 4, as shown in FIG. 3. Floor 4 can be a series of scaffold boards 5, or any structure capable of supporting a person for walking thereon such as plywood or aluminum sections, and attachable to either the vertical support members 2, the horizontal support members 3, or both. Floor 4 has a walking surface 6, and a passageway 7 through the waling surface 6, as shown in FIG. 3. Passageway 7 can be any opening through the walking surface 6. Generally, for ease of construction of the scaffold hatch system 8, pasageway 7 will be rectangularly shaped. In the embodiment shown in FIG. 3, passageway 7 is located in one corner of scaffold system 1.

Figure 2:
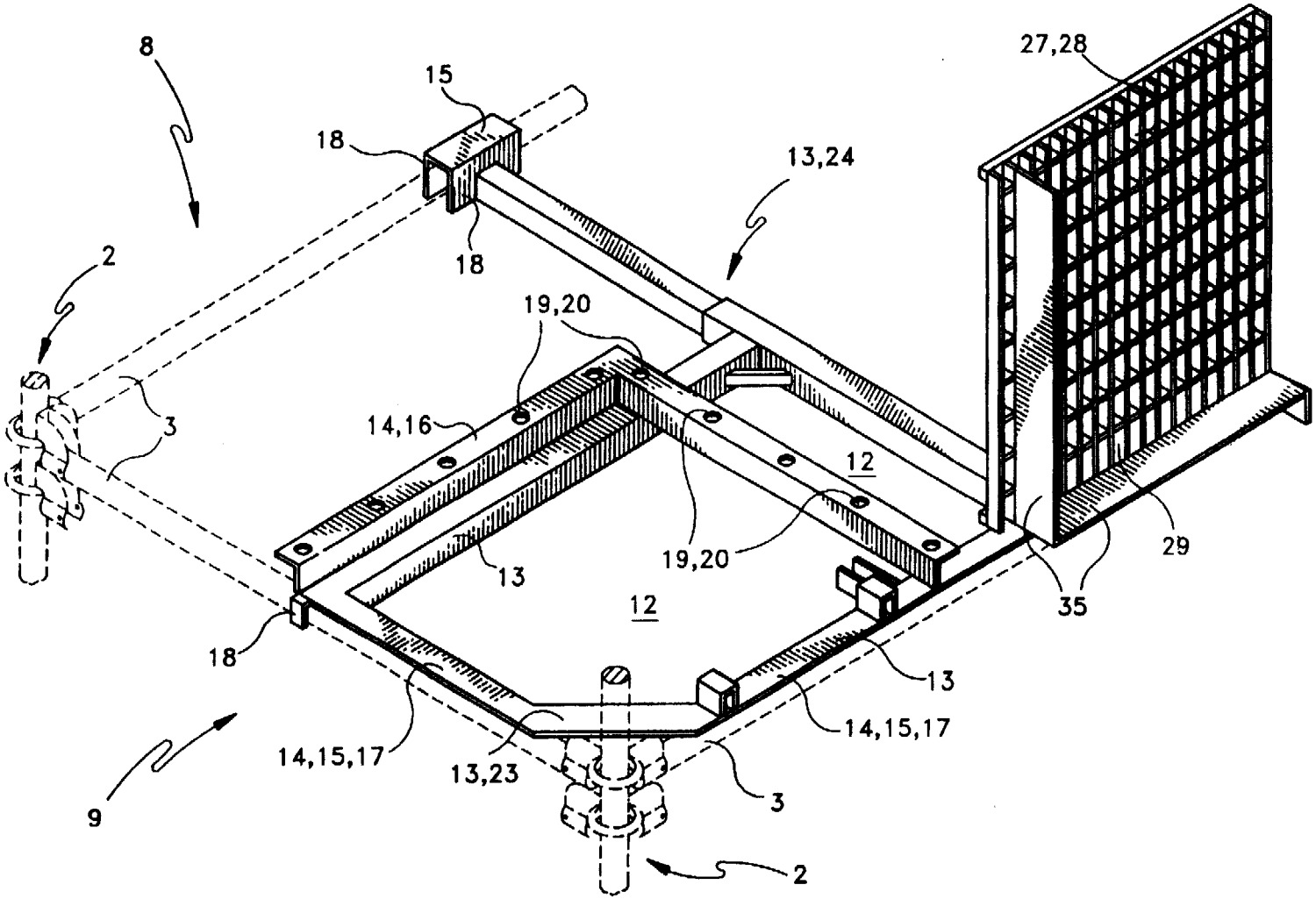
FIG. 2 an exploded view of an embodiment of the invention.

As shown in FIG. 2, scaffold hatch system 8 has a frame member 9. Frame member 9 defines an opening 12, where opening 12 is sized to be alignable with passageway 7. In the embodiment shown in FIG. 2, frame member 9 includes five sides 13. One of the sides 13 is an angled side 23, while another side 13 includes an expandable section 24. The angled side 23 allows the frame member 9 to fit a corner of scaffold section 10. The expandable section 24 allows one side 13 of the invention to expand in length in order to bridge across the width of scaffold section 10 and engage two horizontal support members 3. In this fashion, the dimensions of frame member 9 can be kept to the minimum size needed to allow a person to pass through opening 12, helping to reduce the weight and size and of the scaffold hatch system 8. Additionally, by minimizing the size of frame member 9, the need to employ non-standard sized flooring in order to engage frame member 9 is also minimized. While similar advantages would be achieved by including a single side 13 of fixed length sufficient to bridge across two horizontal support members 3, such an embodiment is not as portable as a frame member 9 with an expandable section 24 and, consequently, is not preferred.

Figure 4:
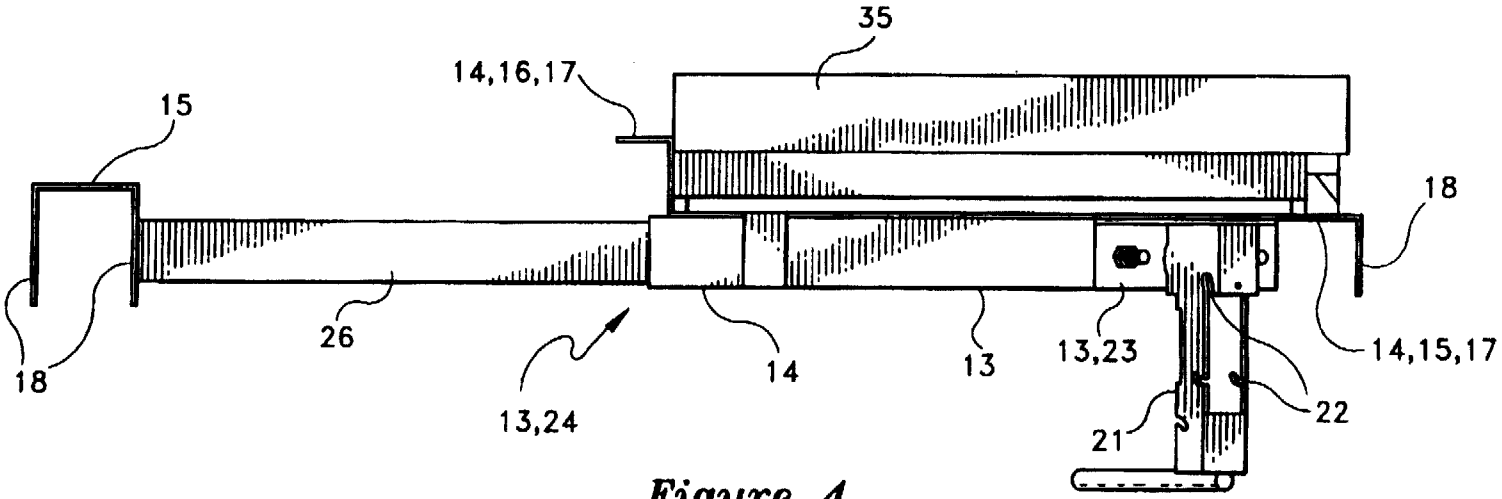
FIG. 4 is a side view of an embodiment of the invention

In the embodiment shown in FIGS. 2 and 4, expandable section 24 is a hollow first tube 25, shown as rectangular in cross-section, into which a smaller cross-sectional second tube 26 is slidably engaged, where the combined lengths of the first tube 25 and second tube 26 is greater than the distance between two horizontal support members 3 of a scaffold section 8. As shown in FIG. 2, the end of the second tube 26 distal from the first tube 25 has a horizontal member lip section 15 attached to supportively engage a horizontal support member 3. The expandable section 24 may be constructed of sliding rods or bars, or any other device known in the art which is capable of expanding and supporting weight in an expanded configuration.

Frame member 9, when inserted in passageway 7, is supported by scaffolding system 1. Frame member 9 can engage and be supported by scaffold system 1 in at least three locations: the vertical support members 2; the horizontal support members 3; and the floor 4. To achieve this supporting function, frame member 9 can include various engagement means for engaging the scaffold system 1. Several such engagement means are shown in FIGS. 2 through 4.

One type of engagement means is lip means 14. FIGS. 2–4 show two types of lip means 14: horizontal member lip sections 15 adapted to engage horizontal support members 3, and floor lip sections 16, adapted to engage the floor 4. In the embodiment shown in FIG. 1, horizontal member lip sections 15 are flanges 17 on the frame member 9 projecting outwardly from the frame member 9 and supportively engagable with at least one horizontal support member 3 of the scaffold system 1. The horizontal member lip sections 15 may support the frame member 9 by simply resting on the horizontal support members 3, or may be clamped, bolted, screwed, clipped or affirmatively attached by other means known to those in the art. For instance, FIGS. 2 and 3 show horizontal member lip sections 15 further having support retaining means 18 to help retain horizontal member lip sections 15 engaged with horizontal support members 3.

The embodiment shown in FIGS. 2 and 3 also show floor lip sections 16. Floor lip sections 16 are raised flanges 17 sized to supportively engage the floor 4 by resting upon the walking surface 6. Consequently, when the frame member 9 is placed in a scaffold system 1, frame member 9 is in substantial alignment with the walking surface 6 of the floor 4, thereby adding to the safety features of the scaffold hatch system 8 by reducing the potential for a person to trip upon the installed frame member 9. Floor lip sections 16 may also include floor retaining means 19 to retain engagement between the floor 4 and the floor lip sections 16. In the embodiment shown in FIGS. 2 and 3, floor retaining means 19 includes a series of holes 20 through the floor lip section 16 for through which pins or other devices can be inserted through to be attached to the floor 4 when the scaffold hatch system 8 is installed.

The invention may also be attached to the vertical support members 2 of a scaffold system 1. Shown in FIG. 4 is one embodiment of a connector 21 for supportively engaging the frame member 9 to one vertical support member 2. Connector 21 is attached to frame member 9 at angled side 23. Connector 21 has channels 22 for engaging cups 11 of vertical support members 1. Connector 21 may include a locking means for locking the connector 21 to the vertical support member 2. Various forms of connectors 21 and locking means are known in the art, for instance, those shown or cited in U.S. Pat. No. 5,028,164 issued to Williams. While the connector 21 is shown to be attachable to a vertical support member 2 having cups 11, other forms of connectors 21 are available for vertical support members 2 which lack cups 11. Such forms can include a clamping device or a pinning device or other means known to those in the art for supportively engaging the frame member 9 to a vertical support member 2.

The embodiment of the frame member 9 shown in FIGS. 1, 2 and 3 includes horizontal member lip sections 15, floor lip sections 16, expandable section 24 and a connector 21. This embodiment thus is supported on all sides 13 of the frame member 9, providing a extremely stable scaffold hatch system.

The scaffold hatch system can also includes a cover means 27 for reducing the likelihood of a person falling through the opening 12. As shown in FIGS. 1 through 3, the cover means 27 can include a hatch 28, with a top surface 29. Hatch 28 may be attached to frame member 9, such as by slidably engaging frame member 9, or as is shown in FIG. 1–3, by pivotally engaging frame member 9. As shown in FIG. 2, it is not necessary that the hatch 28, when closed, totally obstruct the opening 12. The hatch 28 shown in FIG. 2 partially covers the opening 12, that portion of the opening 12 not covered by hatch 28 will be covered, when the invention is installed in a scaffold system, by the floor 4 as is shown in FIG. 4.

It is preferred that the hatch 28, when closed, be capable of supporting weight. The preferred embodiment of the invention provides for the frame member 9 and top surface 29 of hatch 28, when closed, to be substantially in alignment with the walking surface 6 of floor 4. In this fashion, the floor 4 walking surface 6 and top surface 29 of closed hatch 28 will provide a smooth uninterrupted working surface, maximizing the working area and enhancing the safety features of the invention.

Figure 5:
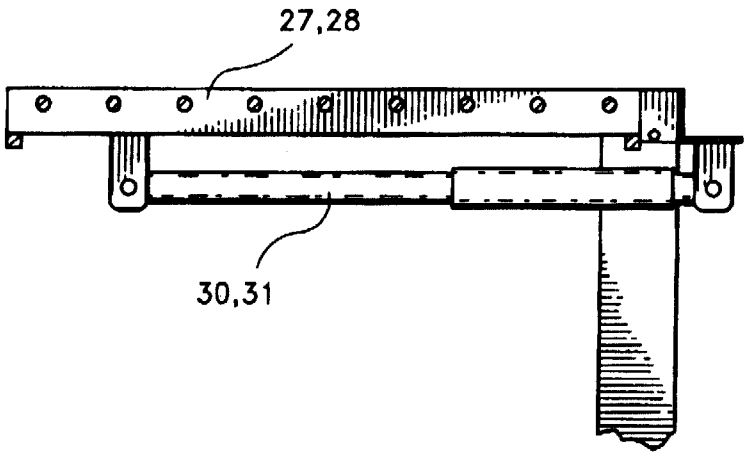
FIG. 5 is a side view of an embodiment of the damping means of the invention.

To prevent the hatch 28 from unexpectedly closing, the hatch 28 may include a damping means 30, such as a hydraulic door closer 31, as shown in FIG. 5. The invention may also include a biasing means to bias hatch 28 in the closed position (not shown). Several types of hydraulic door closers 31 perform both a biasing and damping function.

An additional safety feature that can be included on the hatch 28 is kick plate 35. Kick plate 35 acts as a barrier to help prevent articles on the floor 4 from being kicked off the walking surface 6.

Finally, the scaffold hatch system 1 can include a ladder means to allow a user to access the opening 12 when the invention is installed in a scaffold system 1. Preferably, a ladder means would allow a scaffold user to access the walking surface 6 by climbing in the interior space 35 of scaffold section 10. Such a ladder means can include a flexible ladder, such as a chain or rope ladder means, or a fixed ladder, such as a conventional step or expandable ladder. The scaffold system 1 may have a series of horizontal support members 3 configured to function as a ladder means. As shown in FIG. 1, when scaffold system 1 includes cups 11 on vertical support members 2, a series of horizontal support members 3 can be positioned on the scaffold section 10 to form rungs 33 of a ladder. A person wishing to access the walking surface 6 of the floor 4 would then climb the rungs 33, climbing in the interior 34 of the scaffold section 10. Climbing in the interior 34 to access the walking surface 6 through hatch 28 is inherently safer than climbing the scaffold section 10 on its exterior 35 and having to climb over or through any safety restraints located on or above the walking surface to access the walking surface 6.

There are, of course, other embodiments which are obvious from the foregoing descriptions of the invention which are intended to be included within the scope of the invention defined by the following claims.

I claim:

1. A scaffold hatch system comprising a frame member with an opening therethrough, said frame member having a plurality of sides, with a single one of said sides having an expandable section for bridging the width of different width scaffolding systems, said frame member being supportably attachable to a scaffolding system, said scaffolding system including a plurality of horizontal support members, a plurality of vertical support members and a floor having a walking surface with a passageway therethrough, said opening of said frame being alignable with said passageway and;

a hatch sized to partially cover said opening, said hatch being attached to said frame member and said hatch, when closed, being capable of supporting the weight of a person.

2. A scaffold hatch system according to claim 1, wherein said frame member has a top surface, said frame member being sized so that said top surface is substantially alignable with said walking surface of said floor.

3. A scaffold hatch system section according to claim 1, wherein said frame member further includes at least one retaining means for retaining said frame member on said scaffold system.

4. A scaffold hatch system according to claim 1, wherein said frame member further comprises at least one lip means, said lip means being supportably engagable with said scaffold system.

5. A scaffold hatch system according to claim 4, wherein said lip means is supportable engagable with said floor.

6. A scaffold hatch system according to claim 4, wherein said lip means is supportably engagable with at least one of said horizontal support members.

7. A scaffold hatch system according to claim 4, wherein said lip means is a flange section.

8. A scaffold hatch system according to claim 1 further comprising a connector attached to said frame member for engaging one of said vertical support members.

9. A scaffold hatch system according to claim 1, wherein said hatch is pivotally attached to said frame member, said scaffold hatch system further comprising a damping means to damp the pivoting movement of said hatch.

10. A scaffold hatch system according to claim 9, wherein said damping means is a hydraulic door closer.

11. In a scaffolding system including a plurality of vertical support members and a plurality of horizontal support members connected to said vertical support members, said vertical and horizontal support members forming a scaffold section, a floor supportably attached to said scaffold section, said floor having a walking surface and a passageway therethrough, said passageway sized to allow a person to pass therethrough, scaffold hatch system comprising a frame member having a plurality of sides, a single one of said sides being expandable for bridging various spacing between two of said horizontal support members, said frame member having an opening, said frame member being removably attached to said scaffolding system so that said opening in said frame members aligns with said passageway in said floor.

12. A scaffold hatch system according to claim 11 further comprising a ladder means for accessing said frame member.

13. A scaffold hatch system according to claim 12, wherein said ladder means comprises a series of said horizontal support members positioned on two of said vertical support members so that each of said series forms the steps of a ladder.

14. A scaffold hatch system according to claim 11 further comprising a cover means for reducing the likelihood of a person falling through said opening in said frame member.

15. A scaffold hatch system according to claim 14, wherein said cover means is a hatch attachable to said frame member.

* * * * *